United States Patent [19]

Theurer et al.

[11] 4,423,684

[45] Jan. 3, 1984

[54] TRACK LEVELLING AND TAMPING MACHINE WITH HYDRAULIC PRESSURE CONTROL SYSTEM

[75] Inventors: Josef Theurer, Vienna; Gernot Böck, Aschach; Mihir Ganguly, Linz, ail of Austria

[73] Assignee: Franz Plasser Bannbaumaschinen-Industrie Gesellschaft m.b.H., Vienna, Austria

[21] Appl. No.: 341,292

[22] Filed: Jan. 21, 1982

[30] Foreign Application Priority Data

Feb. 2, 1981 [AT] Austria ..... 470/81

[51] Int. Cl.[3] ..... E01B 27/17

[52] U.S. Cl. ..... 104/7 R; 104/12

[58] Field of Search ..... 104/7 R, 7 B, 8, 10, 104/12

[56] References Cited

U.S. PATENT DOCUMENTS 3,807,311 4/1974 Plasser et al. ..... 104/12

3,895,583 7/1975 Theurer ..... 104/12

3,910,195 10/1975 Theurer ..... 104/12

*Primary Examiner*—Randolph Reese

*Attorney, Agent, or Firm*—Kurt Kelman

[57] ABSTRACT

In a mobile track leveling and tamping machine, a hydraulic control system operates a drive for reciprocating vibratory tamping tools. The system includes a hydraulic fluid containing receptacle, a three-way proportional electro-hydraulic valve having an outlet connected to one cylinder chamber of the drive and another outlet connected to the hydraulic fluid containing receptacle, a hydraulic pressure regulator steplessly adjustable to a desired maximum tamping pressure exerted by reciprocation of the tools, a differential element having two inputs and an output connected to the valve, and a threshold value stage connected between the transmitter and one of the differential element inputs, the other input being connected to the regulator and a third outlet of the valve being connected to the other cylinder chamber whereby the hydraulic pressure therein is controlled in response to the threshold value.

4 Claims, 2 Drawing Figures

Fig.1
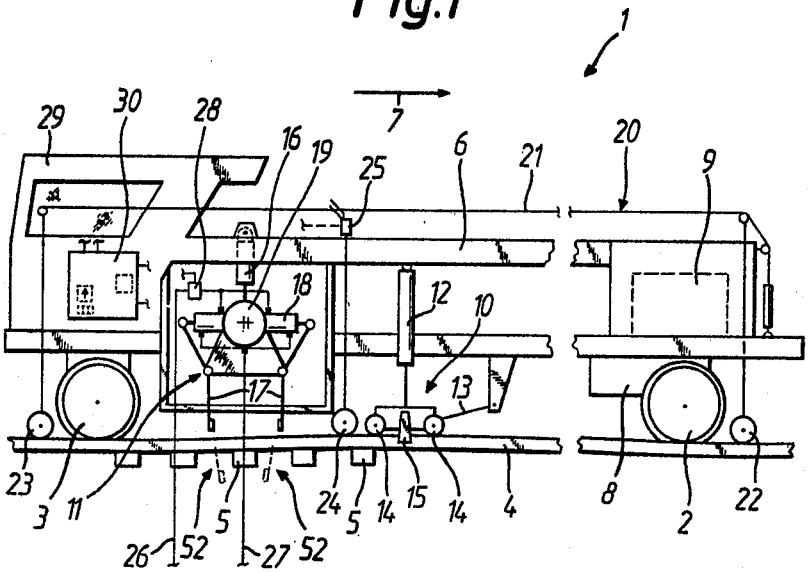
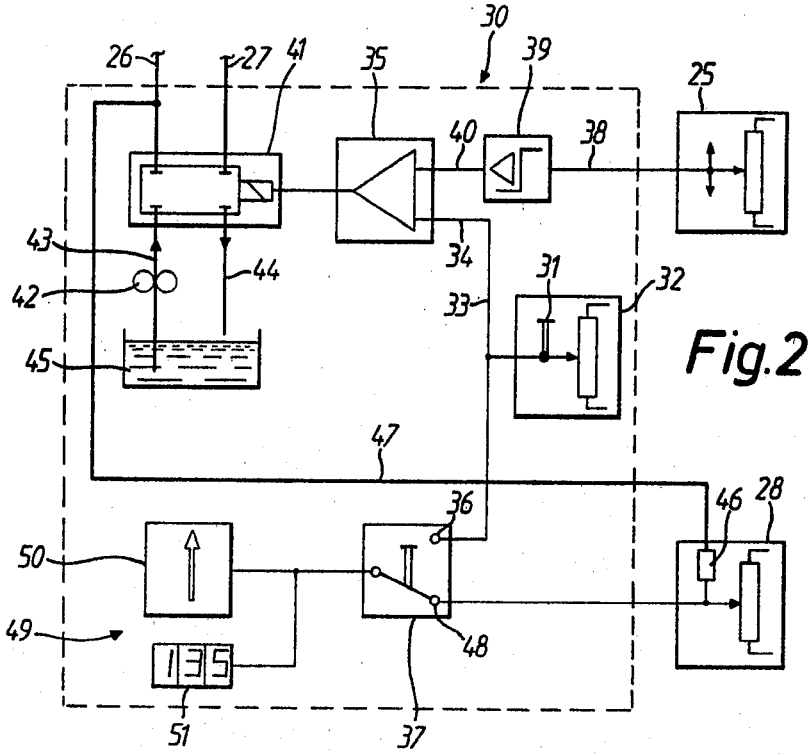
Fig.2

TRACK LEVELLING AND TAMPING MACHINE WITH HYDRAULIC PRESSURE CONTROL SYSTEM

The present invention relates to a mobile track leveling and tamping machine comprising a frame mounted for mobility on the track, vibratory and reciprocatory ballast tamping tools vertically adjustably mounted on the frame, a leveling reference system including a transmitter emitting an electrical control signal indicating a sensed track level, a hydraulically operated drive for reciprocating the tamping tools, the drive including a cylinder and a piston reciprocable therein, the piston dividing the cylinder into two chambers, and a hydraulic control system operating the drive.

U.S. Pat. No. 3,807,311, dated Apr. 30, 1974, discloses such a machine comprising an automatic control for the reciprocating drive of the tamping tools so as to regulate the ballast compaction, the hydraulic pressure in the drive being responsive to level errors in the uncorrected track. For this purpose, the leveling reference system of the machine includes a transmitter emitting a level error signal ahead of the tamping tools in the operating direction of the mobile machine, and one input of a differential element is connected to the transmitter to receive the level error signal therefrom. The other input of the differential element is connected to a hydraulic pressure regulator for the drive. The output of the differential unit is connected to a solenoid valve controlling the hydraulic pressure in the drive. The higher the level error, the higher the pressure whereby a uniform ballast compaction is obtained along the entire leveled track section over which the machine is operated. However, this control system requires the arrangement of a further track sensing element between the track lifting means and the tamping head, with a corresponding signal transmitter to monitor and control the actual track level after lifting and raising of the track under the increased tamping pressure.

U.S. Pat. No. 3,895,583, dated July 22, 1975, discloses a mobile track leveling and tamping machine wherein a controlled degree of ballast compaction is obtained in proportion to the track level error by connecting a pressure control valve to a transmitter emitting a level error signal. The track is held at the leveled position by a reference against upward pressure of the tamped ballast. Such machines equipped with automatic stops preventing excessive raising of the leveled track have been commercially successful but this equipment is relatively expensive and may, therefore, not be practical, particularly for simple machines. On the other hand, the quality of ballast tamping depends primarily on the selected ballast tamping pressure. If this pressure is too low, the ballast compaction in the bed is insufficient. If the pressure is too high, it will raise the track above the level indicated by the reference system (unless this is prevented by the expensive stop means provided in U.S. Pat. No. 3,895,583). This produces undesirable track leveling results.

It is the primary object of this invention to improve the hydraulic control system operating the reciprocating drive for tamping tools in mobile track leveling and tamping machines of the indicated type so as to prevent excessive raising of the leveled track under the tamping pressure by simple means while simultaneously assuring a maximum tamping pressure.

The above and other objects are accomplished according to the invention with a hydraulic control system including a receptacle containing hydraulic fluid and a three-way proportional electro-hydraulic valve having one outlet connected to one of the cylinder chamber of the reciprocating drive cylinder and another outlet connected to the hydraulic fluid containing receptacle. A hydraulic pressure regulator is steplessly adjustable to a desired maximum tamping pressure exerted by reciprocation of the tamping tools. The system further includes a differential element having two inputs and an output connected to the valve, and a threshold value stage connected between the transmitter and one of the differential element inputs, the other input being connected to the regulator and a third outlet of the valve being connected to the other cylinder chamber whereby the hydraulic pressure therein is controlled in response to the threshold value. The hydraulic pressure regulator may be a potentiometer.

This improved hydraulic control system effectively and simply regulates the pressure in the hydraulically operated reciprocating drive of the tamping tools, based on the realization that any tendency of a potential overraise of the leveled track may be readily deduced from the level error as it is first detected by the transmitter of the electrical control signal indicating a sensed track level and may be utilized for suitably lowering the preadjusted maximum tamping pressure set at the hydraulic pressure regulator. Thus, a mobile track leveling and tamping machine equipped with this control system assures not only that the tamping pressure will not raise the leveled track above the desired level determined by the reference system but also provides maximum tamping pressures for achieving the highest possible and uniform compaction of the ballast while maintaining the desired track level without the use of stop means.

For instance, a limit value may be empirically determined to assure the accurate maintenance of the desired level of the finished track, this limit value indicating any excess amount by which the track may be raised in the region of the error signal transmitter above the level indicated by the signal while maintaining a pre-selected maximum tamping pressure. Such an insignificant track overraise, for instance of the order of magnitude of about 0.3 mm, is advantageous because the track is at a lower level in the range of the rear undercarriage than at the error signal transmitter which is arranged between the track lifting means and the tamping tools because of the naturally curved line of the lifted rails, due to the flexing thereof under the lifting force. When this limit value has been reached, it may be considered as a signal that the ballast has been compacted to the desired degree. By setting this as an electrical threshold value in a stage connected between the transmitter and one of the differential element inputs, the three-way hydraulic pressure regulating valve will not be actuated by the differential element when the limit or threshold value is not reached so that the desired maximum pressure set at the hydraulic pressure regulator will be maintained until tamping has been completed. On the other hand, when the threshold value is exceeded, the reciprocating or tamping pressure will be automatically reduced proportionally to such an overraise.

The machine with this control system is structurally very simple and requires neither additional track level sensors nor stop means for holding down the leveled track. Existing track leveling and tamping machines may incorporate this control system without any substantial restructuring.

The above and other objects, advantages and features of the present invention will become more apparent from the following detailed description of a now preferred embodiment thereof, taken in conjunction with the somewhat schematic drawing wherein FIG. 1 is a side elevational view of a mobile track leveling and tamping machine equipped with the control system of this invention, and FIG. 2 is a simplified circuit diagram of the hydraulic and electrical control circuits constituting the hydraulic control system operating the reciprocating drive of the tamping tools.

Referring now to the drawing and first to FIG. 1, there is shown generally conventional track leveling and tamping machine 1 comprising frame 6 having undercarriages 2, 3 mounted for mobility in the operating direction indicated by arrow 7 on a track constituted by rails 4 fastened to ties 5. The machine is self-propelled and has drive 8 for moving it along the track. Power plant 9 of the machine is mounted above front undercarriage 2.

The machine is equipped with generally conventional track lifting and lining means 10 for vertically and laterally moving the track as well as a tamping head 11 associated with each track rail. Hydraulic cylinder drive 12 links track lifting and lining means 10 to machine frame 6 for vertically moving this means and pull rod 13 links the lifting and lining means to the machine frame for moving it therewith along the track. Track lifting and lining means 10 carries lining rollers 14 constituted by flanged wheels engaging the track rails as well as lifting hook 15 which is pivotal into and out of an operating position wherein the hook subtends the respective track rail head for engagement therewith. Hydraulic cylinder drive 16 connects each tamping head 11 to machine frame 6 and each tamping head carries vibratory and reciprocatory ballast tamping tools 17 which are thus vertically adjustably mounted on the frame. The tamping tools are arranged in pairs for immersion in the ballast cribs adjacent each tie 5, respective pairs of tamping tools being disposed on the gage and field sides of rails 4. The tamping tools of each pair are reciprocal in the direction of track elongation by hydraulically operated drives 18 for reciprocating tamping tools 17 and these drives are connected to centrally arranged vibrating drive 19 constituted by a cam shaft mechanism. Each reciprocating drive 18 includes a cylinder and a piston reciprocable therein, the piston dividing the cylinder into two chambers. Machine 1, furthermore, comprises leveling reference system 20 illustrated herein as tensioned reference wire 21 extending in a vertical plane defined by a respective track rail. The front end of the reference wire is anchored to track rail sensor 22 running on an uncorrected track section in front of the machine while the reference wire rear end is supported on a corrected track section behind machine 1. A third track sensor 24 runs on the track rails between track lifting and lining means 10 and tamping heads 11 for sensing the track level at this measuring point and this sensor carries transmitter 25 emitting an electrical control signal indicating the sensed track level. In the present embodiment, this transmitter is constituted by a rotary or slide potentiometer which cooperates with reference wire 21. All of this structure and its operation are well known.

As schematically indicated in FIG. 1, all the corresponding cylinder chambers of reciprocating drives 18 are connected by hydraulic mains 26 and 27, respectively, to the hydraulic circuit of machine 1 in a manner to be explained hereinafter. Transmitter 28 emitting an electrical measuring signal indicating the actual tamping pressure and which may be continuously adjusted is mounted in hydraulic main 26 leading to the inner cylinder chambers of drives 28, i.e. the cylinder chambers adjacent central vibrating drive 19. The emitted signal corresponds to the prevailing hydraulic pressure in this main.

Operator's cab 29 is mounted at the rear end of machine frame 6 and control console 30 is arranged in the cab. In a manner to be described hereinafter, the control console is connected to transmitter 25, transmitter 28 and reciprocating drives 18.

FIG. 2 diagrammatically illustrates the hydraulic control system operating drives 18. The illustrated control system includes receptacle 45 containing hydraulic fluid which is delivered by pump 42 in fluid delivery line 43 to inlet main 26 and returned to the receptacle through outlet main 27 and return line 44. Three-way proportional electro-hydraulic valve 41 has an outlet connected to main 26 leading to one of the cylinder chambers of each drive 18 and another outlet connected to return line 44 leading to hydraulic fluid containing receptacle 45. A third outlet of the valve is connected to the other cylinder chambers of drives 18 through main 27.

Hydraulic pressure regulator 32 is illustrated as a potentiometer and is steplessly adjustable to a desired maximum tamping pressure exerted by reciprocation of the tamping tools. Differential circuit element 35 has two inputs 34 and 40 and an output connected to valve 41. Threshold value stage 39 is connected in line 38 between transmitter 25 emitting an electrical control signal indicating the sensed track level and differential element input 40 and the other input 34 is connected to tamping pressure regulator 32 by line 33. The tamping pressure regulator has adjustment element 31 enabling adjustment of a desired maximum tamping pressure for a given track section to be corrected at the beginning of track correction operation. Line 33 also connects tamping pressure regulator 32 to contact 36 of manually operable switch 37. The control signal emitted by potentiometer 25 is an output voltage of this potentiometer and circuit 39 is adjustable for passing varying voltages so that the threshold value stage transmits a voltage adjustable to correspond to the output voltage of transmitter 25. In this manner, the hydraulic pressure in main 27 leading to the other cylinder chambers of drives 18 is controlled in response to the threshold value set at stage 39.

Actual tamping pressure measuring signal transmitter 28 is a potentiometer operated by pressure gage 46 mounted in conduit 47 connected to inlet main 26 to measure the hydraulic pressure therein. The output of transmitter 28 is connected to the second contact 48 of switch 37 to transmit the measuring signal thereto. A pressure indicating instrument 49 is connected to manually operable switch 37 and comprises in the illustrated embodiment analog indicator 50 as well as digital indicator 51. In this manner, it is possible selectively or continuously to monitor the tamping pressure values during the operation and to control the operation of the tamping pressure regulators. Using potentiometers as transmitters of the electrical control signals and a threshold value stage with an adjustable voltage transmission makes it possible directly to compare the output voltages which respectively indicate the sensed track level and the tamping pressure, and simply to set the threshold value at which circuit 39 will pass the voltages. It is equally simple to amplify the output voltage of differential circuit element 35, derived by the difference between the input voltages fed thereto from potentiometers 25 and 32, such amplification being required for the proper actuation of valve 41.

The hydraulic control system described hereinabove operates in the following manner during a track leveling and tamping operation:

Before the operation along a given track section begins, adjustment element of tamping pressure regulator 32 is set for a desired or permissible maximum tamping pressure for this section. For control of the desired tamping pressure, switch 37 is thrown from the illustrated position into the position wherein potentiometer 32 is connected through contact 36 to pressure indicating instrument 49. Machine 1 is then advanced along the track in the direction of arrow 7 until tamping tools 11 straddle a respective track tie 5 in the manner shown in FIG. 1. Track lifting drive 12 is operated in response to a control signal received from reference system transmitter 25 to level the track in relation to the reference system and, if desired and in a manner not shown herein, the track may similarly be lined in a conventional manner while being leveled. Drive 16 is then operated to lower tamping head 11 so as to immerse tamping tools 17 in cribs 52 adjacent tie 5, and drives 18 are operated when the tamping tools are immersed in the ballast to reciprocate the tools while they are being vibrated by drive 19. The tools are reciprocated and tamping pressure is applied to the ballast by supplying hydraulic fluid to main 26 through proportional three-way valve 41 under a pressure pre-set by regulator 32, the control voltage from potentiometer 32 being transmitted through line 33, input 34 and the output of differential circuit element 35 to the electro-hydraulic valve for control of the valve thereby. Thus, the delivery of hydraulic fluid from pump 42 to main 26 and the inner cylinder chambers of drives 18 is fully controlled by regulator 32 to assure maximum tamping pressure. This pressure is transmitted through conduit 47 to pressure gage 46 of signal transmitter 28. By throwing switch 37 into the illustrated position, the pressure indicating signal from transmitter 28 is transmitted to indicators 50 and 51 of pressure indicating instrument 49.

The track level is continuously sensed by transmitter 25 during tamping. As long as the track level does not rise above the desired level determined by leveling reference system 20, potentiometer 25 emits a relatively low voltage as an electrical control signal indicating the sensed track level, this voltage being lower than that set at threshold value circuit 39 for permitting a voltage to pass therethrough. In other words, the low voltage below the set threshold will not pass through stage 39 to differential circuit element 35, i.e. it will not influence the actuation of valve 41 and the valve will be actuated solely by the output voltage of potentiometer 32. Since no voltage is applied to input 40 of element 35, its output will be the output voltage of potentiometer 32 and this output voltage will be fully applied to the magnetic coil of proportional solenoid valve 41 so that the maximum pressure will continue to be applied to the reciprocating drives.

As the reciprocation of the tamping tools will increasingly compact the ballast under tie 5, the ballast will begin to be displaced upwardly and the rising ballast level will cause the track supported on the ballast to be raised correspondingly. If the maximum tamping pressure would be continued, it would eventually raise the track under this pressure above the level set by the reference system. Since this tendency of the track to be overraised by the tamping pressure is a known parameter readable at track level control signal transmitter 25, the output voltages of transmitter 25 and the voltage-transmitting level of threshold value stage 39 are so set in relation to each other that circuit 39 will be energized, i.e. a voltage will pass therethrough, as soon as transmitter 25 senses a track level which is a little above the level determined by reference system 20, for instance about 0.3 mm higher. At this point, the output voltage of potentiometer 25 is high enough to pass through threshold circuit 39 and is transmitted to input 40 of differential element 35. In this manner, the output voltage of the differential element is constituted by the difference between the output voltages of potentiometers 32 and 25, i.e. it is reduced by the voltage transmitted from track level signal transmitter 25. This causes actuation of valve 41 to diminish the pressure in main 26 correspondingly. This pressure control can be monitored by the operator in cab 29 by observing pressure indicating device 49. The completion of tamping and the raising of the tamping head is then effected automatically in a conventional manner in response to the operation of a pressure switch actuated by a set minimum pressure and a selected timing cycle.

The triggering of the tamping pressure control, i.e. the reduction of the set maximum pressure, is set to be produced only after a slight overraise determined by the threshold value because the lifted track rails will be a little higher in the range of the track lifting means where transmitter 25 is located than at read undercarriage 3 where the track rails are held down under the weight of the machine. The threshold value at stage 39 will be selected on the basis of various criteria readily ascertained empirically, such as the cross section of the track rails, the lifting stroke required for leveling and the spacing of the track lifting means from the undercarriages of the machine. When maintenance work is done on track sections requiring relatively little track correction and, therefore, involving little or no lifting, the threshold value may be negative so that the tamping pressure control becomes effective before the track has reached the desired level. The threshold value stage may preferably be constituted by an amplifier with an adjustable threshold value and an adjustable output voltage.

Preferably, lifting drive 12 of the track lifting means has a control responsive to the control signal emitted by transmitter 25. In this manner, a single signal transmitter associated with each rail will be sufficient for the operation of the track lifting means.

While the invention has been described in connection with a now preferred embodiment by way of illustration, many modifications and variations will readily occur to those skilled in the art. More particularly, a leveling reference system with optical reference lines, such as laser or infrared beams, may be used. Furthermore, the positioning of the track level sensing control signal transmitter may be changed. For instance, transmitter 25 may be positioned at the tamping head, for example centrally thereof. In addition, different types of track lifting and lining means may be used.

What is claimed is:

1. A mobile track leveling and tamping machine comprising the combination of a frame mounted for mobility on the track, vibratory and reciprocatory ballast tamping tools vertically adjustably mounted on the frame, a leveling reference system including a transmitter emitting an electrical control signal indicating a sensed track level, a hydraulically operated drive for reciprocating the tamping tools, the drive including a cylinder and a piston reciprocable therein, the piston dividing the cylinder into two chambers, and a hydraulic control system operating the drive, wherein the control system includes (a) a receptacle containing hydraulic fluid, (b) a three-way proportional electro-hydraulic valve having an outlet connected to one of the cylinder chambers and another outlet connected to the hydraulic fluid containing receptacle, (c) a hydraulic pressure regulator steplessly adjustable to a desired maximum tamping pressure exerted by reciprocation of the tamping tools, (d) a differential element having two inputs and an output connected to the valve, and (e) a threshold value stage connected between the transmitter and one of the differential element inputs, the other input being connected to the regulator and a third outlet of the valve being connected to the other cylinder chamber whereby the hydraulic pressure therein is controlled in response to the threshold value.

2. The track leveling and tamping machine of claim 1, wherein the hydraulic pressure regulator is a potentiometer.

3. The track leveling and tamping machine of claim 1 or 2, wherein the control signal is an output voltage of the transmitter and the threshold value stage transmits a voltage adjustable to correspond to the output voltage.

4. The track leveling and tamping machine of claim 1 or 2, further comprising track lifting means and a control for the track lifting means, the control being responsive to the control signal.

* * * * *